United States Patent [19]

Lin et al.

[11] Patent Number: 4,952,847

[45] Date of Patent: Aug. 28, 1990

[54] STABLE IGNITION MEANS FOR FLUORESCENT LAMP OR THE LIKE

[76] Inventors: Tieng-Fu Lin; Mouteh Liu, both of P.O. Box 10160, Taipei, Taiwan

[21] Appl. No.: 361,856

[22] Filed: Jun. 5, 1989

[51] Int. Cl.[5] ..... H05B 41/14

[52] U.S. Cl. ..... 315/290; 315/DIG. 7; 315/208; 315/209 R; 315/DIG. 2

[58] Field of Search ..... 315/DIG. 2, DIG. 7, 315/290, 289, 224, 208, 209 R

[56] References Cited

U.S. PATENT DOCUMENTS 2,265,323 12/1941 Spanner ..... 315/180

3,906,302 9/1975 Wijsboom ..... 315/209 R 4,168,453 9/1979 Gerhard ..... 315/DIG. 7

4,414,492 11/1983 Hanlet ..... 315/290

*Primary Examiner*—Eugene R. Laroche

*Assistant Examiner*—Amir Zarabian

[57] ABSTRACT

An ignition circuit for fluorescent lamp includes a transformer having coreless windings connected in parallel with a fluorescent lamp with the coreless windings having inductive reactance matched with a capacitive reactance or internal resistance of the fluorescent lamp for forming a harmonic oscillation of a multivibrator in order for stably igniting the fluorescent lamp for saving electric energy.

2 Claims, 2 Drawing Sheets

STABLE IGNITION MEANS FOR FLUORESCENT LAMP OR THE LIKE

BACKGROUND OF THE INVENTION

H. J. Spanner disclosed in his U.S. Pat. No. 2,265,323 a "Gas and Metal Vapor Discharge Tube and Means for Preventing Flicker Therein" by using a special type of self-heated solid activated electrodes, and a means for controlling the heat dissipation in order to obtain a high vapor pressure of the vaporized metals, which however may have the following drawbacks:

1. In order to fit so many special self-heated electrodes, a specially-designed tube must be provided to limit its versatile applications since the tubes out of order must also be replaced with specially designed tubes, causing maintenance problems.

2. It will consume much electric energy for warming up the so many electrodes. For increasing temperature required by the tubes, the service life of the lamp may be shortened.

3. If environmental temperature is too low, it may influence the ignition of the tube.

The present inventors have found the defects of a conventional gas discharge tube and invented the present stable ignition means for fluorescent lamp or the like.

SUMMARY OF THE INVENTION

The object of the present invention is to provide an ignition means for fluorescent lamp or the like including a transformer having coreless windings connected in parallel with a fluorescent lamp with the coreless windings having inductive reactance matching with a capacitive reactance or an internal resistance of the fluorescent lamp for forming a harmonic oscillation of a multivibrator in order for stably igniting the fluorescent lamp even under serious voltage drop, for saving electric energy and for adjusting illumination of the lamp or the like.

DETAILED DESCRIPTION

Figure 1:
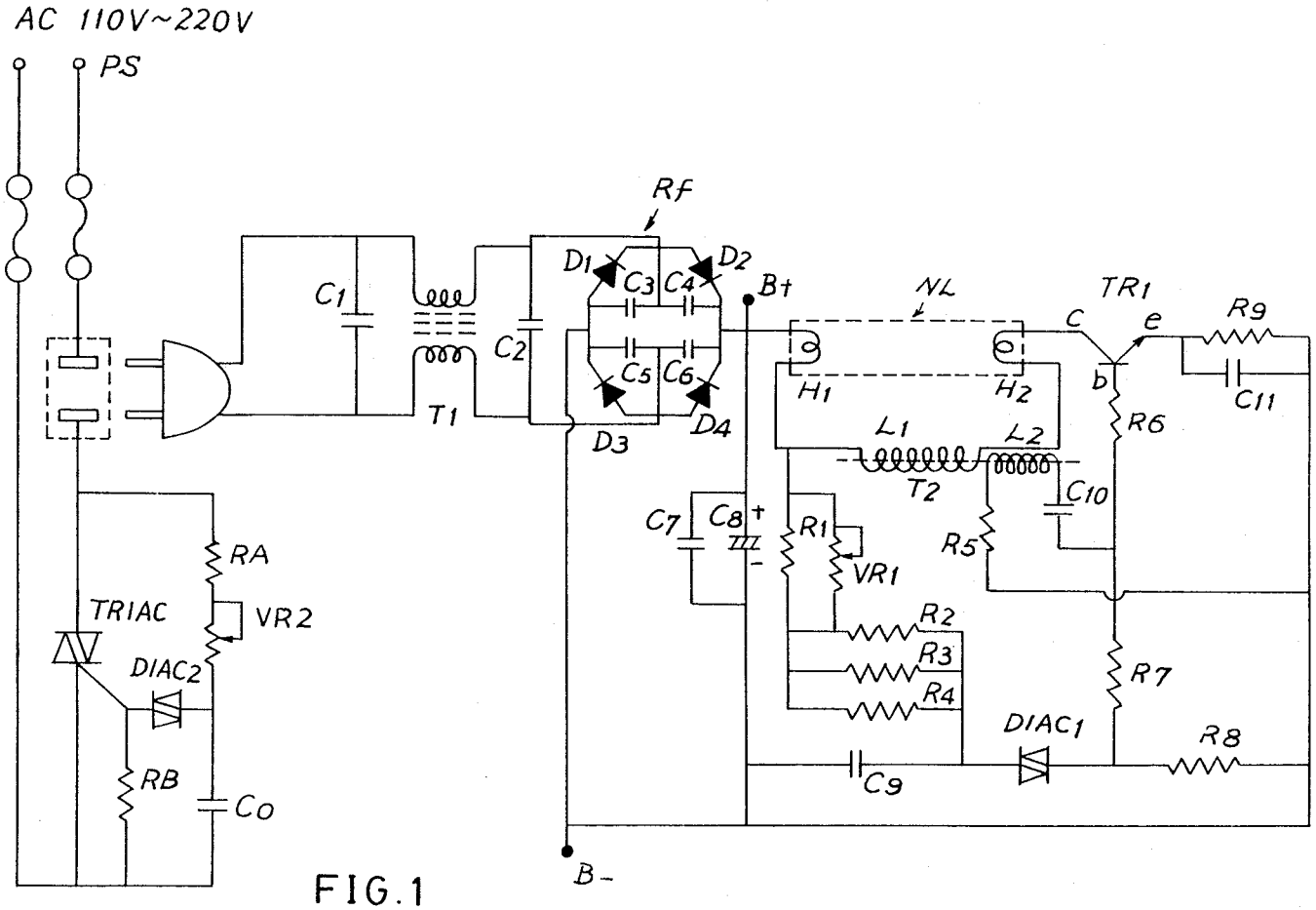
FIG. 1 is a diagram showing an electric circuit of the present invention.

As shown in FIG. 1, the present invention comprises: a rectifier Rf for rectifying a power source PS of alternative current through a high-frequency filter T1, a fluorescent lamp NL such as NL-40 having filaments H1, H2 formed in two opposite ends of the lamp, a coreless transformer T2 having a primary winding L1 and a secondary winding L2 having an inductive reactance XL matching with an internal resistance or capacitive reactance XC of the fluorescent lamp NL connected in parallel with the fluorescent lamp NL, a first variable resistor VR1 having its one end connected between a positive terminal B+ of a rectified voltage of the power source PS through a left filament H1 of the lamp NL and having its another end connected to a base b of a transistor TR1 having its collector c connected to a right filament H2 of the lamp NL through a first diode AC switch DIAC1, and a second variable resistor VR2 connected in series between two terminals of the power source PS through a second diode AC switch DIAC2 and a triode AC switch TRIAC as shown in a left portion of FIG. 1.

The primary winding L1 of the coreless transformer T2 is parallelly connected between the two filaments H1, H2 of the lamp NL. The emitter e of transistor TR1 is connected to a negative terminal B− of the rectified voltage of the power source PS through a resistor R9 which is connected in parallel with a capacitor C11. The secondary winding L2 of the coreless transformer T2 has its one end connected with the base b of the transistor TR1 through a capacitor C10 and a resistor R6 and has its another end connected to the negative terminal B− through a resistor R5. The DIAC1 has its one end connected to the positive terminal B+ through capacitors C9, C7, and C8 of which the C7 is connected in parallel with the C8, and has its another end connected to the negative terminal B− and the emitter e of transistor TR1 through resistors R8,R9. In a circuit of the second variable resistor VR2 as shown in FIG. 1, the VR2 and resistor RA will charge the capacitor Co to have a voltage enough to trigger DIAC2, which is then discharged through resistor RB to exert a pulse to trigger the TRIAC so as to close a circuit for adjusting the voltage across the two terminals of the input power source PS. For suitable variation of a resistance operated by the first variable resistor VR1, several resistors R1, R2, R3 and R4 are provided in this invention. The second variable resistor VR2 is also connected with a resistor RA as shown in FIG. 1.

In using the ignition means of the present invention as shown in FIG. 1, the rectified voltage B+ after being rectified through the rectifier Rf will charge the capacitor C9 for saturating the DIAC1 for discharging the current through resistor R8, thereby exerting a discharge pulse of C9 through the resistor R7 for triggerring the base b of the transistor TR1 through R7, R6 for saturating the collector c and emitter e of the transistor TR1. The biasing current through the transistor TR1, R9 and B− will electromagnetically induce the secondary winding L2 of the transformer T2 forming a multivibrator which is continuously oscillated for igniting the fluorescent lamp NL.

For adjusting the illumination of lamp NL, both variable resistors VR1, VR2 can be variated.

The first variable resistor VR1 may adjust the charging time of C9 to accordingly adjust a current passing through the lamp NL and transistor TR1 to variable the illumination of the lamp NL. Whereas the second variable resistor VR2 is effected to change the voltage across the rectifier Rf so as to reduce the illumination of the lamp NL, especially suitable for lighting at night (sleeping) time.

Figure 2:
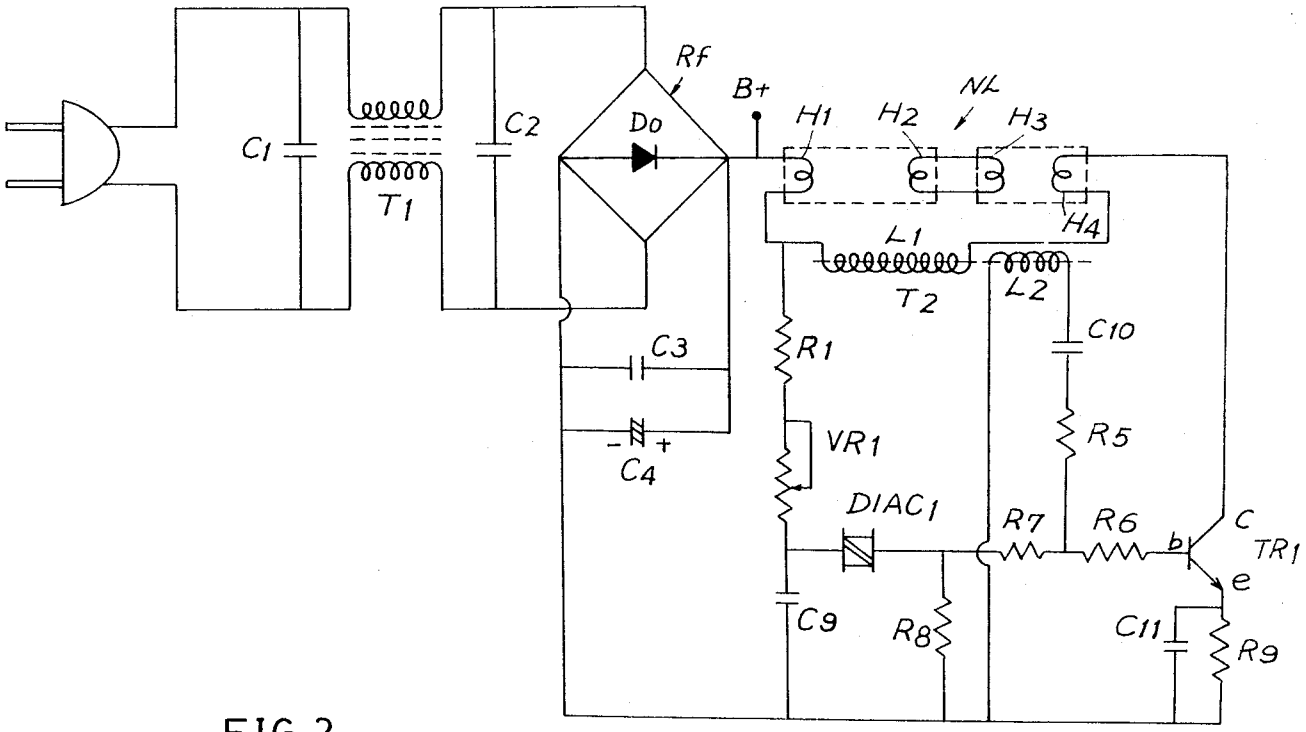
FIG. 2 is a circuit diagram of the present invention when used for two fluorescent lamps.

As shown in FIG. 2, two fluorescent lamps NL-40, NL-20 can be connected in series in which a left filament H3 of the second lamp NL-20 is connected to the right filament H2 of the first lamp NL-40 and a right filament H4 of the second lamp NL-20 is respectively connected with the primary winding L1, and the collector c of the transistor TR1 as shown in FIG. 2. The internal capacitive reactance of the lamps may be matched with the inductive reactance of the windings of the transformer T2 for exerting a harmonic oscillation in accordance with the present invention as aforementioned.

The present invention has the following advantages in comparison with a conventional gas discharge tube:

1. Since the inductive reactance of the transformer windings is matched with the capacitive reactance of the fluorescent lamp, a harmonic oscillation will occur for igniting the fluorescent lamp for saving energy.

2. The variable resistors VR1, VR2 may adjust the illumination of the lamp so that even at sleeping time there is no need to provide an additional mini light. The illumination of the fluorescent lamp can be optionally adjusted to meet any illuminating requirement.

3. Even under great fluctuation of power source or voltage drop, this invention may ignite the lamp successfully and smoothly.

4. The frequency f of the oscillation can be adjusted according to the formula:

$$f = \frac{1}{2\pi\sqrt{LC}}$$

wherein the reactances of L and C can be adjusted for obtaining a suitable frequency for preventing any flicker harmful to an user's eyes.

5. The lamp can be ignited regardless of environmental temperatur, and can also be ignited even under low temperature.

6. For matching the reactance of the transformer windings, several fluorescent lamps can be connected in series if the reactance of the lamps are matching with that of the transformer windings.

This invention may also be applied for igniting other suitable lamps of electronic light, such as a flasher lamp.

We claim:

1. A stable ignition means for fluorescent lamp or the like comprising:

a transformer having coreless windings connected in parallel with a fluorescent lamp with the coreless windings of the transformer having inductive reactance matched with a capacitive reactance or internal resistance of the fluorescent lamp;

a rectifier for rectifying a power source of alternative current for forming a positive terminal and a negative terminal of a rectified voltage;

said transformer having a primary winding having one end of the primary winding connected to a first filament of the fluorescent lamp and the positive terminal of the rectified voltage and having the other end of the primary winding connected to a second filament of the fluorescent lamp opposite to the first filament and connected to a collector of a transistor, and having a secondary winding electromagnetically induced from said primary winding of said transformer having one end of the secondary winding connected to the negative terminal of the rectified voltage and having the other end of the secondary winding connected to a base of the transistor through a first capacitor;

a first diode AC switch having its one end connected to the positive terminal of the rectified voltage through a second capacitor and having the other end of the first diode AC switch respectively connected to the base of the transistor and connected to an emitter of the transistor of which the emitter is connected to the negative terminal of the rectified voltage; and a first variable resistor secured between the first filament of the fluorescent lamp and the first diode AC switch; whereby upon a variation of the first variable resistor for adjusting an illumination of the lamp and upon a saturation of the first diode AC switch for saturating the transistor, a harmonic oscillation will exert for stably igniting the fluorescent lamp by a multivibrator comprised of said secondary winding, said primary winding of said transformer, said lamp, said transistor and said first capacitor.

2. A stable ignition means for fluorescent lamp according to claim 1, wherein said power source is further connected with a second adjusting means for adjusting an illumination of the fluorescent lamp, including a second variable resistor connected in parallel with a triode AC switch connected between two terminals of the power source and a second diode AC switch connected in series between the triode AC switch and the second variable resistor.

* * * * *